United States Patent [19]

Littlefield et al.

[11] 4,215,766

[45] Aug. 5, 1980

[54] CONSTRUCTION MODULE

[75] Inventors: Reginald D. Littlefield; Stuart Shinn, both of Toronto, Canada

[73] Assignee: Supreme Aluminum Industries, Ltd., Scarborough, Canada

[21] Appl. No.: 972,385

[22] Filed: Dec. 22, 1978

[30] Foreign Application Priority Data

Nov. 30, 1978 [CA] Canada ..... 317149

[51] Int. Cl.[2] ..... E06C 1/10; E06C 7/08

[52] U.S. Cl. ..... 182/46; 182/178; 182/194; 182/228

[58] Field of Search ..... 182/178, 46, 194, 195, 182/228; 46/25, 24, 23; 52/726, 637

[56] References Cited

U.S. PATENT DOCUMENTS

| | | | |
|---|---|---|---|
| 58,984 | 10/1866 | Ckertizza | 182/178 |
| 331,876 | 12/1885 | Gates | 182/178 |
| 411,730 | 9/1889 | Pierson | 182/178 |
| 518,961 | 5/1894 | Lang | 182/178 |
| 700,690 | 5/1902 | Hogan | 182/178 |
| 1,555,344 | 9/1925 | Whitney | 182/178 |
| 3,029,897 | 4/1962 | Moberg | 182/178 |
| 3,476,211 | 11/1969 | Cormier | 182/178 |
| 3,757,896 | 9/1973 | Lee | 182/46 |
| 3,881,571 | 5/1975 | Moulton | 46/25 |
| 4,024,929 | 5/1977 | Mintz | 182/178 |

*Primary Examiner*—Reinaldo P. Machado

*Attorney, Agent, or Firm*—George H. Riches

[57] ABSTRACT

A construction module which when combined with other identical modules may be used to form ladders, wall or ceiling supports, etc. Each module overlaps on each side at three points with two other modules and a single connecting means may be inserted in the area of overlap to connect the modules together. The modules may be molded from plastic so that the construction assembly is water resistant and non-conducting.

7 Claims, 4 Drawing Figures

CONSTRUCTION MODULE

BACKGROUND OF THE INVENTION

This invention relates generally to construction modules and more particularly to construction modules which can be combined to construct ladders, wall and ceiling supports and the like.

The most relevant prior art is in the ladder field. In the past there have been developed inventions relating to sectional ladders. These sectional ladders use identical repeating sections which when combined formed a longer ladder of the desired height. Examples of these types of units are taught in the following U.S. Pat. Nos. 58,984 to Ckertizza (Oct. 23, 1866), 331,876 to Gates (Dec. 8, 1885), 411,730 to Pierson (Sept. 24, 1889), 518,961 to Lang (May 1, 1894), 700,690 to Hogan (May 20, 1902).

These references teach the use of smaller wooden ladders which may be combined to form longer ladders. The top of the lower ladder (or the bottom of the upper ladder) is shaped so as to engage the lowest rung on the upper ladder (or the highest rung of the lowest ladder). This is not a very stable structure. Accordingly, in practice, it is found that additional connecting means must be used to connect the smaller ladders together.

The major advantage with these small connectable structures is that the ladder becomes collapsable and can therefore be carried or stored more easily. These small units are not intended to be used so as to be permanently attached in the longer form as the construction procedures for these small ladders are the same as for large ladders, and therefore it is not any saving to make a plurality of smaller ladders instead of a longer ladder the same length as the combined length of the plurality of smaller ladders. These smaller ladders have accordingly not been economically viable as modules for use in constructing longer ladders.

Known ladders are made from wood or metal, usually aluminum metal. Both types of material have their drawbacks. They are difficult to work if unusual shapes are required. Water tends to deteriorate wood ladders and so they cannot be used over extended periods in wet locations, such as is common in mines and on construction sites. Metal ladders are electrical conductors and are thereby restricted in the extent of their use, such as around transmission lines or other worksites where a high current is being used. Colouring of these types of material is also a problem as any applied paints will tend to wear off after extended use.

SUMMARY OF THE INVENTION

Accordingly, it is an object of the present invention to at least partially overcome these disadvantages by providing a construction module which, when assembled with other identical modules, provides a single unit addition to an assembly constructed from these modules. The assembly can therefore be built exactly to the size desired by varying the number of single-unit modules employed.

To this end, in one of its embodiments, the invention provides a construction module comprising a horizontal rung means having two ends, and two identical side means, one attached to each end of the rung means. Each side means has an upwardly extending portion extending above the rung means and a downwardly extending portion extending beneath the rung means. The upwardly and downwardly extending portions are of such shape and size so that a first inner section of the upwardly extending portion of a lower module will lie in touching contact along an overlap area with an outer section of the upwardly extending portion of a higher module and at the same time an outer section of the downwardly extending portion of the higher module lies in touching contact along the overlap area with a second inner section of the upwardly extending portion of the lower module when the two modules are assembled to form a completed structure.

In another of its aspects the invention further provides a construction module comprising a horizontal rung means having two ends, and two identical side means, one attached to each rung means end. Each side means has an upwardly extending portion extending above the rung means and a downwardly extending portion extending below the rung means. Each portion has an inner and an outer face, the downwardly extending portion having a first vertical section on its out face at the lower end thereof, the upwardly extending portion having on a central part thereof a second and a third vertical section on its inner and outer faces respectively.

The upwardly extending portion further has a fourth vertical section on its inner face at the upper end thereof. The first and second vertical sections are coplanar and the third and fourth vertical sections are coplanar. The vertical sections are so positioned that when the fourth vertical sections of a first module are placed against the third vertical sections of a second module, the second vertical sections of the first module are in touching contact with the first vertical sections of the second module.

Other features of the invention include methods of constructing structures from the modules and the structures constructed by those methods.

Further objects and advantages of the invention will appear from the following description taken together with the accompanying drawings.

DETAILED DESCRIPTION OF THE DRAWINGS

The present invention teaches a module which when combined with a plurality of identical modules forms a structure which may be used as a ladder, support or the like. The length of the structure is dictated by the number of modules, and the strength of the material, used, and may be varied by adding to or deleting from the structure. Therefore these structures need not be stocked or manufactured in various lengths.

Figure 1:
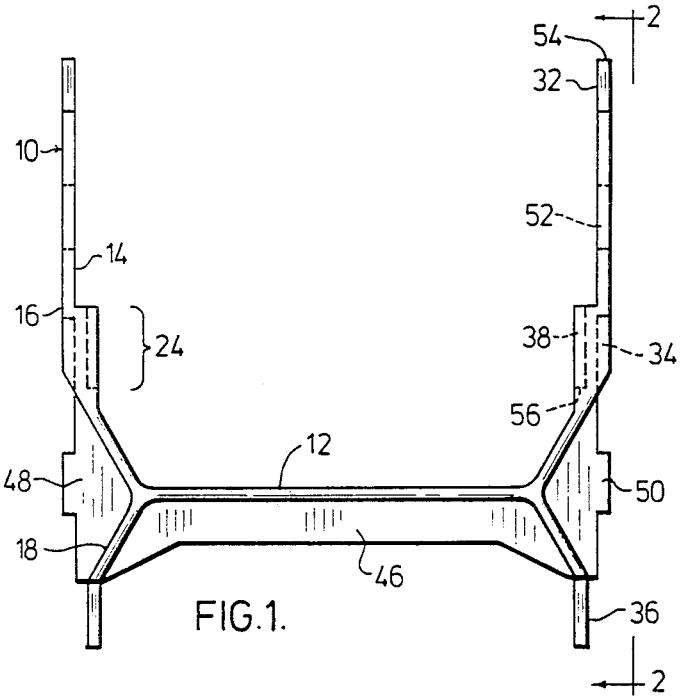
FIG. 1 is a front view of the invention showing some preferred embodiments.
Figure 3:
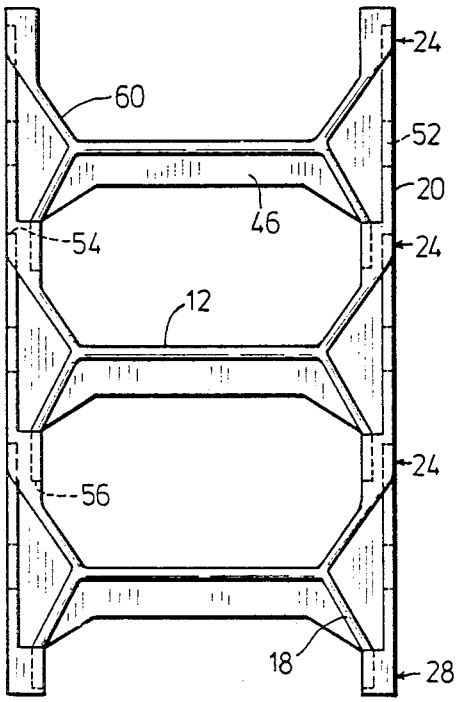
FIG. 3 is a view of a structure constructed using the preferred embodiment of FIG. 1.

FIG. 1 shows the module 10 in the form most preferred by the applicant. It consists essentially of a horizontally oriented rung member 12 and two side members 14. The two side members 14 are identical and are attached one at each end of the rung member 12 defining upwardly and downwardly extending portions 16 and 18 respectively. FIG. 3 shows a ladder or supporting structure 20 which can be constructed using the module 10 shown in FIG. 1. Of course, since FIG. 3 shows a combination of the preferred modules 10 shown in FIG. 1, the structure 20 is also a preferred structure; the invention is not to be delimited by these views.

The module 10, when assembled to form a completed structure 20, defines but a single rung of the structure 20, along with the side walls thereof. It is not intended to be used other than when assembled as shown in FIG. 3. Therefore, the single module 10 need not be sufficiently strong to support the desired weight that will be applied to the completed structure 20. This means that weaker material, or less of the material used, can be used when producing these modules 10. This reduces material and hence cost. This required strength with less material is best attained when using the preferred structure shown in FIGS. 1 and 2 where the modules 10 combine to form the triangularly-shaped sections 22 which provide support for the rungs 12. The resulting honey-combed shape is structurally very strong when compared with other structures built of similar quality and quantities of material.

The ability to use material that would be too weak with other structures does not mean that only such material can be used in constructing the modules 10. Metal or wood is useable, but both are difficult to shape without extensive labour. The applicant's preferred material is a thermoplastic polyester. VALOX, a trade mark of Canadian General Electric, is an example of one suitable thermoplastic polyester. These types of polyesters can be foam molded, a big advantage considering the amount of working that would otherwise be necessary with wood or metal.

The prior art structures all require more than a single point of attachment on each side of the upper and lower structures. Only two ladders are connected together by any single connecting means. Therefore, if only one connecting means is used on each side of the ladder then it is possible for the structure to pivot about the pair (one on each side) of the connecting means. Obviously, this is not a desired feature.

The requirement of additional connecting means is eliminated with the present invention. The module 10 is designed so that when the structure 20 is constructed there will exist areas 24 of overlap where three different modules 10 overlap. Since the modules 10 are identical, then each module 10 will overlap two other modules 10 along three overlap areas 24. However, although each module 10 will overlap along three overlap areas 24, the total number of connecting means on each side will only be equal to the number of modules 10 and not three times that number. Therefore, in effect, only one connecting means is needed on each side of each module 10. This is in contrast to the at least two needed in each side of the known structures.

To produce the structure of the present invention, the upwardly and downwardly extending portions 16 and 18 must be of such a shape and size so that the first inner section 32 of the upwardly extending portion 16 of a lower module 10 lies in touching contact, along the overlap area 24, with the outer section 34 of the upwardly extending portion 16 of an upper module 10 while at the same time the outer section 36 of the downwardly extending portion 18 of an upper module 10 lies in touching contact, along the overlap area 24, with the second inner section 38 of a lower module 10.

Figure 2:
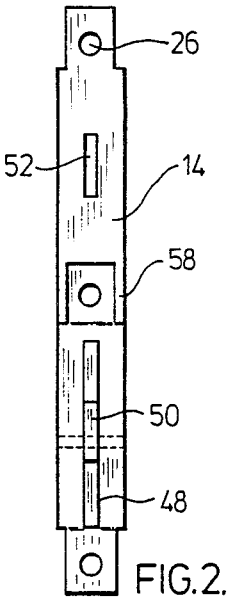
FIG. 2 is a side view of the embodiment in FIG. 1 along the line 2—2.
Figure 4:
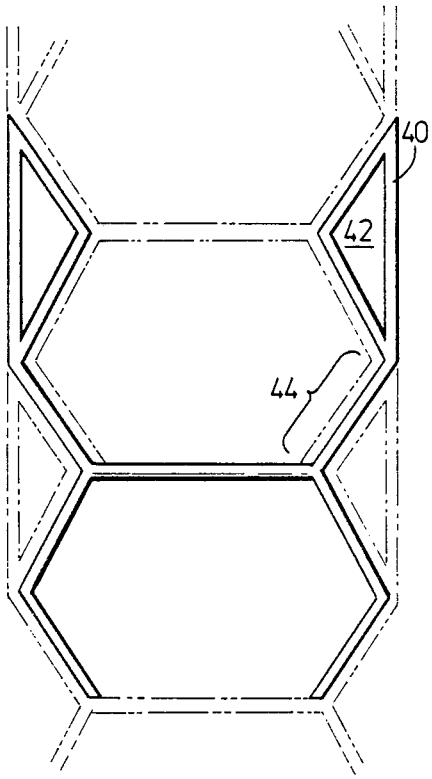
FIG. 4 is a front view of another embodiment of the invention.

The module 10 in FIGS. 1-3 is not the only structure possible. Many different structures are capable of meeting the above noted requirements. FIG. 4 shows another of such possible structures. The module 40 in FIG. 4 also has triangularly shaped sections 42 which add extra strength and support to the structure. The overlap area in this structure is designated by reference numeral 44.

In choosing which of the many possible forms to use to make a structure 20, one should consider the amount of material needed to make the module, the degree of work required to shape the material (or the form if it is to be molded) and the strength of the structure 20 once completed. These variables can be determined by simple experiment. The applicant has found that the module 10 in FIG. 1 is the best structure of those it experimented with which is easy to form, uses a minimum of material and is very strong when combined to form the structure 20. The essential feature is the overlap area 24 where the three modules overlap.

The module 10 can be strengthened in ways other than by simply increasing the thickness or strength of the material from which the module 10 is formed. In its preferred embodiment, the applicant adds a thin web 46 beneath the central portion of rung member 12, running from one side member 14 to the other. This web adds support to the rung member 12 to prevent sagging in the middle when weight is applied to the rung member, as it would be if the structure 20 is used as a ladder.

A second supporting web 48 may be added along the triangular section 22 defined by the side members 14. This supporting web 48 adds strength to the side member, reinforcing the shape of the triangular section 22. By additionally adding a tongue member 50 as part of the supporting web 48, and an appropriately located and shaped aperture 52 in the upwardly extending portion 16 to receive the tongue member 50 when the modules are combined to form a structure 20, then the supporting web 48 in any one module can be used to carry part of the weight of the modules above it. This reduces the stress, and hence the wear, on the connecting means used in the overlap areas 24. The lifetime of these pieces is thereby extended. The satisfactory use of weaker connecting means is also possible.

The applicant has found that further stress on the connecting means can be removed with the preferred structure shown in FIGS. 1 to 3. The inner and outer sections 32, 34, 36, 38 are narrower in width than the remainder of the side member 14. FIG. 2 shows this more clearly. Additionally, the outer section 34 and the second inner section 38 are recessed into the side member 14. A lower module therefore partially supports an upper module on the upper surface 54 of the side member and by the bottom surface 56 defined by the recessed second inner section 38. This can be most clearly seen in FIG. 3.

Recessing the outer section 34 and the inner section 38 provides upraised portions 58 about the sides of these sections. These upraised portions 58 aid in reducing the strain on the connecting means caused by the tendancy of the modules to try to pivot about the connecting means when a force is applied against the face of the structure 20, as would be if the structure were used as a ladder.

The tongue 50, surfaces 54, 56 and upraised portion 58 are very effective in reducing the strain on the connecting means. The applicant has found that when this preferred structure is used that a plastic connecting plug is sufficient. Its use is mainly to keep the three modules in contact against each other. The other embodiments do most of the supporting of the structure 20.

As noted earlier, the modules 10 can be constructed of material which is not strong enough to allow the modules 10 to support any reasonable weight, so long as the structure 20 is sufficiently strong. The lower and upper modules 10 of the structure 20 might therefore require additional support. FIG. 3 shows examples of how the structure 20 might be strengthened at these points. The upwardly extending portion 16 of the top module and the downwardly extending portion 18 of the bottom module are structurally not as strong as the rest of the structure 20. It might therefore be considered to have a specially designed top module 60 wherein the weaker portions, above the overlap area 24, are removed. Similarly, bottom supports 30 which provide the same function as the upper portions of a lower module can be used to add strength to the downwardly extending portion 18 of the bottom module. These specially designed top and bottom sections 60 and 30 will, of course, not be needed if the module 10 is sufficiently strong by itself to carry the weight to be applied during use.

To build the structure 20 shown in FIG. 3 the modules are aligned end to end, or one above the other. The inner and outer sections 32, 34, 36, and 38 are placed in touching contact with each other so as to have three modules overlap in the overlap area 24. Connecting means may then be inserted through these areas of overlap to ensure that the modules lie in contact with each other. Where the preferred structures of FIGS. 1 to 3 are used, the connected means may not be needed if the modules will lie in touching contact without any assistance as the weight of upper modules will be carried not by the connecting means but by the tongue 50 and surfaces 54 and 56. Safety precautions may, however, advise their use even with the preferred embodiments.

Structure 20 may be easily coloured if required. The colouring can be added to the thermoplastic polyester when it is molded. This is preferred to applying the colour to the surface after forming, as such coatings can wear off after extended use.

Although the description of the invention has been given with respect to but a few embodiments, it is not to be construed in a limiting sense. Similarly, the use of this invention should not be limited to ladders, as it may be used wherever supporting structures are required, such as the supports for a platform or a dock. Many variations and modifications of the structure and use will now occur to those skilled in the art. For a definition of the invention, reference is made to the appended claims.

What I claim is:

1. A construction module comprising:

a horizontal rung means having two ends, two identical side means, one attached to the end of the rung means, each side means having an upwardly extending portion extending above the rung means and a downwardly extending portion extending beneath the rung means, the upwardly and downwardly extending portions of such shape and size so that a first inner section of the upwardly extending portion of a lower module will lie in touching contact along an overlap area with an outer section of the upwardly extending portion of a higher module and at the same time an outer section of the downwardly extending portion of the higher module lies in touching contact along the overlap area with a second inner section of the upwardly extending portion of the lower module when the two modules are assembled to form a completed structure.

2. A construction module comprising:

a horizontal rung means having two ends, and two identical side means, one attached to each rung means end, each side means having an upwardly extending portion extending above the rung means and a downwardly extending portion extending below the rung means, each portion having an inner and an outer face, the downwardly extending portion having a first vertical section on its outer face at the lower end thereof, the upwardly extending portion having on a central part thereof a second and a third vertical section on its inner and outer faces respectively, the upwardly extending portion further having a fourth vertical section on its inner face at the upper end thereof, the first and second vertical sections being coplanar, the third and fourth vertical sections being coplanar, the vertical sections so positioned that when the fourth vertical sections of a first module are placed against the third vertical sections of a second module, the second vertical sections of the first module are in touching contact with the first vertical sections of the second module.

3. The module as claimed in claim 2 wherein:

the downwardly extending portion extends outwardly and downwardly to the first vertical section, and the upwardly extending portion extends outwardly and upwardly to the second and third vertical sections, then outwardly then upwardly therefrom to the fourth vertical section, the two portions thereby defining a V-shaped area between the first vertical section and the second and third vertical sections.

4. The module as in claim 3 further comprising:

a thin V-shaped member attached to the outer face of the side member filling the V-shaped area and having an outer edge coplanar with the third vertical section, a tongue member extending outwardwarly from a central portion of the outer edge, a slot member in the upwardly extending member the same size as the tongue member, and the tongue members of the second module positioned to engage the slot members in the first module when the fourth vertical sections of the first module are placed against the third vertical sections of the second module.

5. The module as claimed in claim 4 further comprising apertures in the side members through the vertical sections through which connecting means may be inserted, the apertures so positioned so that they are aligned when the fourth vertical sections of the first module are placed against the third vertical sections of the second module.

6. The module as claimed in claim 5 wherein the rung and side members are a single piece molded from a thermoplastic polyester.

7. The module as claimed in claim 6 wherein the first and second vertical sections are identically shaped and the third and fourth vertical sections are identically shaped, and the second and third vertical sections are narrower than and recessed in the upwardly extending portion.

* * * * *